US005766061A

United States Patent [19]

Bowers

[11] Patent Number: 5,766,061

[45] Date of Patent: Jun. 16, 1998

[54] WAFER CASSETTE CLEANING USING CARBON DIOXIDE JET SPRAY

[75] Inventor: Charles W. Bowers, Torrance, Calif.

[73] Assignee: Eco-Snow Systems, Inc., Livermore, Calif.

[21] Appl. No.: 816,745

[22] Filed: Oct. 4, 1996

[51] Int. Cl.[6] ..... B24C 3/00

[52] U.S. Cl. ..... 451/89; 451/75; 451/39; 451/53

[58] Field of Search ..... 451/28, 53, 7, 451/36, 38, 39, 75, 80, 89, 5

[56] References Cited

U.S. PATENT DOCUMENTS

| | | | |
|---|---|---|---|
| 4,587,771 | 5/1986 | Buchner et al. | 451/28 |
| 4,793,103 | 12/1988 | Baumgart | 451/53 |
| 5,025,597 | 6/1991 | Tada et al. | 451/53 |
| 5,233,795 | 8/1993 | Reas | 451/38 |
| 5,315,793 | 5/1994 | Peterson et al. | 451/89 |

*Primary Examiner*—Timothy V. Eley
*Assistant Examiner*—Derris H. Banks
*Attorney, Agent, or Firm*—R. Craig Armstrong

[57] ABSTRACT

Apparatus for cleaning a wafer carrying cassette. The cassette is fabricated as open top box having closed sides and a plurality of grooves formed in its interior that each hold a wafer. The apparatus includes an enclosure having an entry and an exit, and a conveyor is provided for transporting the cassette through the enclosure. A first plurality of jet spray nozzles are disposed adjacent to the entry that produce a carbon dioxide jet spray that cleans exterior surfaces of the cassette as it travels through the entry. A blower produces a flow of air through the enclosure and a filter filters the air flowing through the enclosure. A second plurality of moveable jet spray nozzles is controlled to move into the interior of the cassette to generate a carbon dioxide spray that cleans the interior of the cassette. An electrostatic control system is provided that controls buildup of electrostatic charge on the cassette caused by the carbon dioxide spray. Heaters control the temperature of the cassette at or above room temperature to prevent condensation.

8 Claims, 2 Drawing Sheets

WAFER CASSETTE CLEANING USING CARBON DIOXIDE JET SPRAY

BACKGROUND

The present invention relates generally to apparatus for cleaning wafer cassettes, and more particularly, to wafer cassette cleaning apparatus that employs a cryogenic aerosol, such as a liquid carbon dioxide jet spray, as the cleaning agent.

Currently, cassettes are used to transport semiconductor and plastic wafers used in the manufacture of hard disks, optical disks, and integrated circuits, and the like. Such cassettes are manufactured by Sumitomo Corporation, and KOMAG, for example. The cassettes are cleaned after manufacture and are then sealed in plastic bags so that they are not contaminated during shipment.

However, after shipping the sealed cassettes to the disk or integrated circuit manufacturer, they are removed from the sealed enclosure and inserted into processing equipment where the wafers are loaded into them for transport during various phases of manufacturing. Consequently, the cassettes are exposed to contaminants in the atmosphere that deposit onto the cassettes prior to loading into the wafer processing equipment. These contaminants are on the order of about 100 particles per cubic foot of air, but even this small amount of contaminants leads to defects in the manufactured wafers.

Heretofore, apparatus has not been available to clean the cassettes after receipt from the cassette manufacturer. Consequently, the disk or integrated circuit manufacturer has been required to use cassettes that have less than optimum cleanliness during wafer processing. It would therefore be an advance in the art to have cassette cleaning apparatus that may be used to clean cassettes after receipt from manufacturers and prior to use in wafer processing equipment.

Accordingly, it is an objective of the present invention to provide for wafer cassette cleaning apparatus for cleaning cassettes prior to use in wafer processing equipment. It is also an objective of the present invention to provide for wafer cassette cleaning apparatus that uses a cryogenic aerosol jet spray, such as a liquid carbon dioxide jet spray, to clean the cassettes.

SUMMARY OF THE INVENTION

To meet the above and other objectives, the present invention provides for wafer cassette cleaning apparatus that is used to clean wafer carrying cassettes prior to their use in wafer processing equipment. The cassettes are fabricated as open top boxes having closed sides and a plurality of U-shaped grooves formed in the interior that each holds a single wafer. The wafer cassette cleaning apparatus comprises an enclosure having a conveyor belt that is used to transport cassettes through the enclosure. The enclosure has an entry fabricated as an "aero door" comprising a plurality of jet spray nozzles that spray carbon dioxide snow across the outside of each cassette as it travels through the entry. The carbon dioxide spray is thus used to clean the outsides of the cassettes. The spray of carbon dioxide snow comprises solid aerosol particles and gas.

The cassettes are transported by the conveyor belt past a first heater that keeps the temperature of the cassettes at or above room temperature to prevent condensation. The cassettes are then transported by the conveyor belt into a central cleaning area of the cassette cleaning apparatus. The central cleaning area is fed with recirculated clean air provided by a blower and a high flow ultra low particulate air (ULPA) filter. The blower and ULPA filter produce a flow of clean air that travels past the moving cassette. The central cleaning area contains a robotic arm having a plurality (array) of jet spray nozzles at its lower end that are controlled to move vertically (along a Z axis). The array of jet spray nozzles are lowered by the robotic arm toward the moving cassette and into the interior of the cassette. The array of jet spray nozzles spray a carbon dioxide spray or snow into the interior of the cassette to clean it. The carbon dioxide jet spray removes contaminants from the interior of the cassette which are carried away by the flow of clean air moving past the cassette.

An electrostatic control system is provided within the wafer cassette cleaning apparatus that controls the buildup of electrostatic charge on the cassettes caused by the carbon dioxide jet spray. A second heater is used to keep the temperature of the cassettes at or above room temperature to prevent condensation prior to removal of the cassettes from the wafer cassette cleaning apparatus.

The present wafer cassette cleaning apparatus eliminates problems and costs associated with water based cleaning systems. For example, a water treatment facility is not required to treat contaminated residue produced by cleaning the wafer cassettes. Also, time is saved in comparison to water based systems, and drying of the cassettes is also not required.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
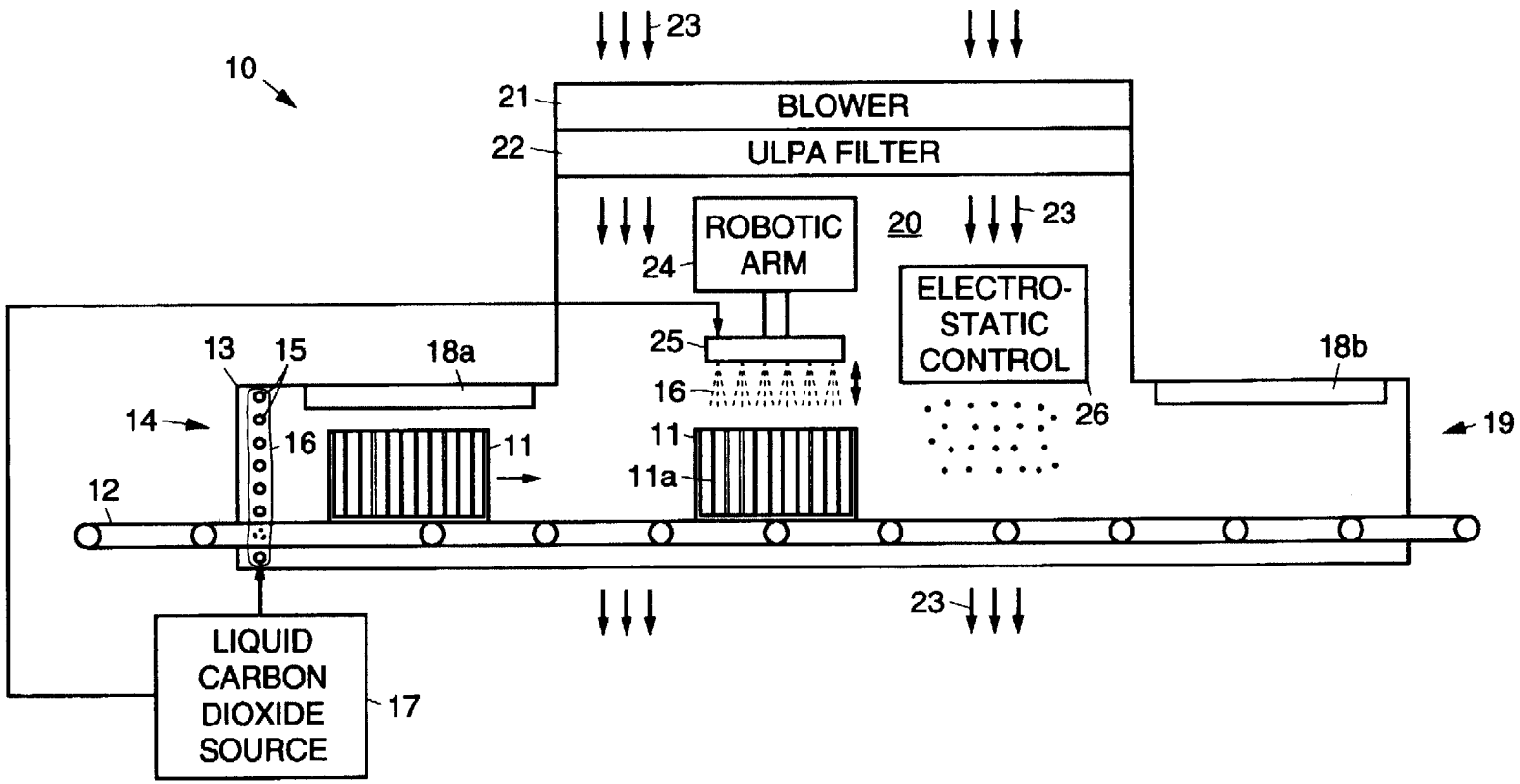
FIG. 1 illustrates, wafer cassette cleaning apparatus in accordance with the principles of the present invention.

Referring to the drawing figures, FIG. 1 illustrates wafer cassette cleaning apparatus 10 in accordance with the principles of the present invention. The wafer cassette cleaning apparatus 10 is used to clean wafer carrying cassettes 11 prior to their use in wafer processing equipment. The cassettes 11 are fabricated as open top boxes having closed sides and a plurality of U-shaped grooves 11 a formed in the interior that each hold a single wafer.

The wafer cassette cleaning apparatus 10 comprises an enclosure 13 having an entry 14 and an exit 19. The enclosure 13 has a conveyor belt 12 for transporting the cassettes 11 through the enclosure 13. The enclosure 13 has an "aero door" type entry 14 having a plurality of inwardly facing jet spray nozzles 15 that produce a carbon dioxide jet spray 16 that flows across the outside of the cassette 11 as it travels through the entry 14. The spray 16 may preferably comprise liquid carbon dioxide snow, for example. The snow is generated by feeding pressurized liquid carbon dioxide stored in a source 17 or tank 17, through the inwardly facing jet spray nozzles 15 at a predetermined pressure. The carbon dioxide jet spray 16 produced by the inwardly facing jet spray nozzles 15 at the entry 14 is used to clean outside surfaces of the cassettes 11.

First and second heaters 18*a*, 18*b* are disposed within the enclosure 13 on opposite ends of a central cleaning area 20 of the cassette cleaning apparatus 10. The central cleaning area 20 comprises an air flow chamber 20 that is fed by a blower 21 and a high flow ultra low particulate air (ULPA) filter 22. The blower 21 and ULPA filter 22 produce a flow of clean air within the central cleaning area 20 of the cassette cleaning apparatus 10. A computer-controlled robotic arm 24 having a plurality or array of jet spray nozzles 25 at its lower end is disposed in an upper portion of the central cleaning area 20.

The array of jet spray nozzles 25 are controlled by the robotic arm 24 to move vertically (along a Z axis) so that the array of jet spray nozzles 25 are lowered by the robotic arm 24 into the interior of a moving cassette 11. The array of jet spray nozzles 25 are coupled to the carbon dioxide source 17 and generate a carbon dioxide jet spray 16 into the interior of the cassette 11 to clean it. An electrostatic control system 26 is disposed within the enclosure 13 that controls buildup of electrostatic charge on the cassettes 11 caused by the carbon dioxide jet spray 16.

In operation, a cassette 11 is transported by the conveyor belt 12 through the entry 14 and the plurality of inwardly facing jet spray nozzles 15. The inwardly facing jet spray nozzles 15 produces a carbon dioxide jet spray 16 that moves across the outside of the cassette 11 as it travels through the entry 14. The carbon dioxide jet spray 16 produced by the inwardly facing jet spray nozzles 15 clean the outside surfaces of the cassette 11.

The cassette 11 is then transported by the conveyor belt 12 past the first heater **18*a* which keeps the temperature of the cassette 11 at or above room temperature to prevent condensation, and into the central cleaning area 20. The central cleaning area 20 is fed with recirculated clean air provided by the blower 21 and ULPA filter 22. As the cassette 11 moves through the central cleaning area 20, the robotic arm 24 is controlled to move vertically to lower the array of jet spray nozzles toward the moving cassette 11 and into the interior thereof. The array of jet spray nozzles project a carbon dioxide jet spray 16 into the interior of the cassette 11 to clean it. The carbon dioxide aerosol removes contaminants from the interior of the cassette 11 which are carried away by the flow of clean air moving past the cassette 11**.

The electrostatic control system controls buildup of electrostatic charge on the cassette 11 created by the carbon dioxide jet spray 16. The second heater 18b keeps the temperature of the cassette 11 at or above room temperature to prevent condensation prior to removal from the wafer cassette cleaning apparatus 10.

Figure 2:
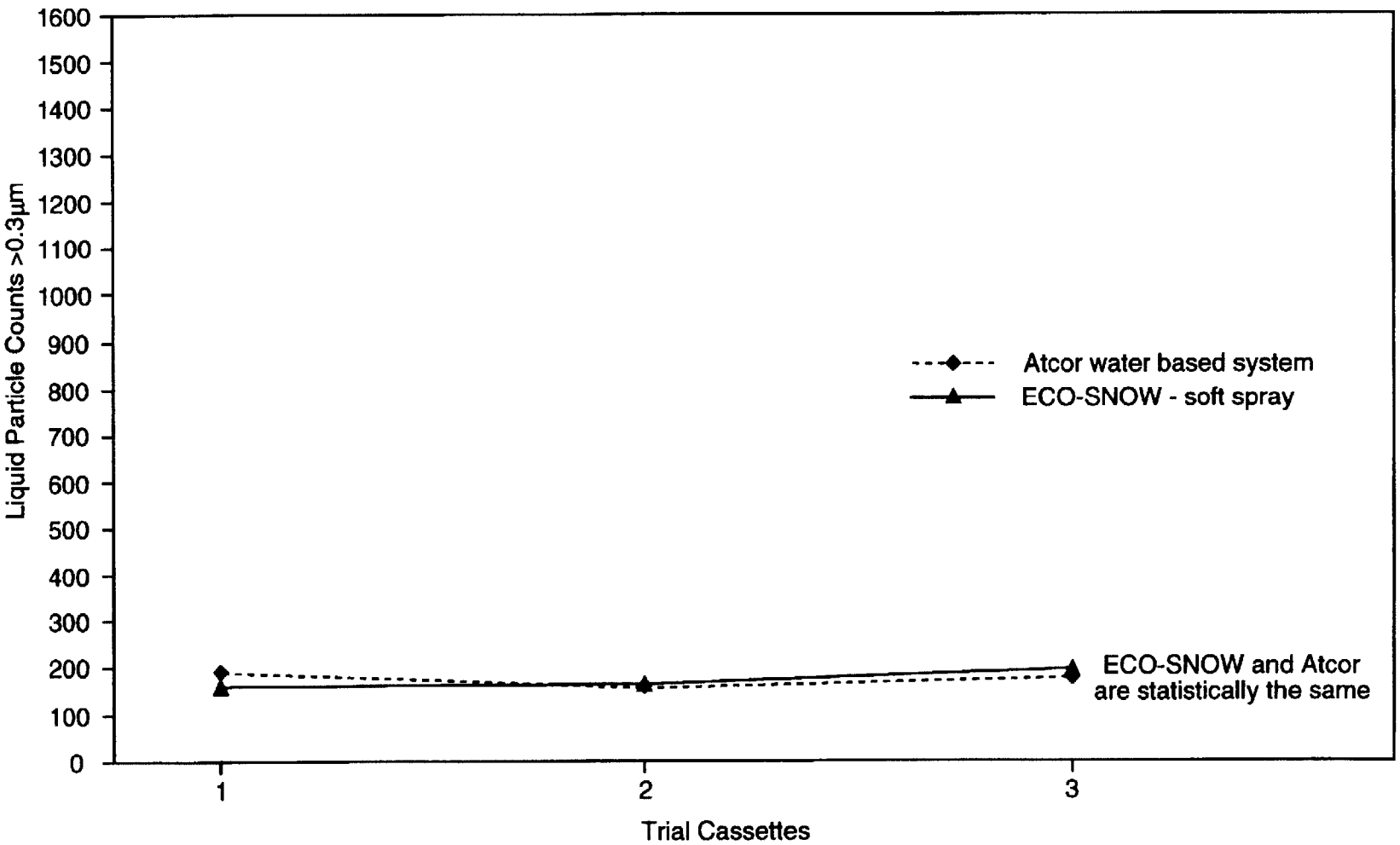
FIG. 2 is a chart showing test results using the wafer cassette cleaning apparatus of FIG. 1.

Referring to FIG. 2, it shows a chart illustrating test results using the wafer cassette cleaning apparatus 10 of FIG. 1 compared with a conventional aqueous cleaning system manufactured by Atcor. As is shown in the chart of FIG. 2, the wafer cassette cleaning apparatus 10 has the ability to clean wafer cassettes 11 to produce an acceptable level of contaminants that is comparable to the best aqueous based cleaners, such as those manufactured by Atcor.

The wafer cassette cleaning apparatus 10 minimizes problems and costs associated with water based cleaning systems, such as the Atcor systems and others. For example, a water treatment facility is not required that treats contaminated residue resulting from cleaning the wafer cassettes 11. Also, time is saved in cleaning the cassettes 11 in comparison to water based systems, and in particular, drying of the cassettes 11 is not required.

Thus, wafer cassette cleaning apparatus that uses a liquid carbon dioxide jet spray to clean cassettes used to transport wafers, and the like, has been disclosed. It is to be understood that the described embodiment is merely illustrative of some of the many specific embodiments which represent applications of the principles of the present invention. For example, other cryogenic materials such as nitrous oxide, argon and xenon, for example, may be used in place of carbon dioxide in practicing the present invention. Clearly, numerous and other arrangements can be readily devised by those skilled in the art without departing from the scope of the invention.

What is claimed is:

1. Wafer cassette cleaning apparatus for cleaning a wafer carrying cassette fabricated as open top box having closed sides and a plurality of grooves formed in its interior that each hold a wafer, said apparatus comprising:

an enclosure having an entry and an exit;

means for transporting the cassette through the enclosure;

a first plurality of jet spray nozzles disposed adjacent to the entry for producing a spray of carbon dioxide snow that cleans exterior surfaces of the cassette as it travels through the entry;

a blower for producing a flow of air through the enclosure;

a filter for filtering the air flowing through the enclosure;

a second plurality of moveable jet spray nozzles that is moveable into the interior of the cassette that generates a spray of carbon dioxide snow that cleans the interior of the cassette;

an electrostatic control system for controlling buildup of electrostatic charge on the cassette caused by the carbon dioxide snow; and heater means for controlling the temperature of the cassette at or above room temperature to prevent condensation thereon.

2. The apparatus of claim 1 wherein the first plurality of jet spray nozzles and the second plurality of moveable jet spray nozzles are coupled to a carbon dioxide source for coupling carbon dioxide to the nozzles at a predetermined pressure.

3. The apparatus of claim 2 wherein the second plurality of moveable jet spray nozzles is coupled to a computer-controlled robotic arm that is used to lower the second plurality of jet spray nozzles into the interior of a moving cassette.

4. The apparatus of claim 1 wherein the filter comprises an ultra low particulate air filter.

5. The apparatus of claim 1 wherein the heater means are respectively disposed at the entry and exit of the enclosure.

6. Wafer cassette cleaning apparatus for cleaning a wafer carrying cassette fabricated as open top box having closed sides and a plurality of grooves formed in its interior that each hold a wafer, said apparatus comprising:

an enclosure having an entry and an exit;

a conveyor belt disposed through the enclosure for transporting the cassette through the enclosure;

a first plurality of jet spray nozzles disposed adjacent to the entry that produce a carbon dioxide spray that flows across outside surfaces of the cassette as it travels through the entry;

a carbon dioxide source coupled to the first plurality of jet spray nozzles for coupling carbon dioxide to the nozzles at a predetermined pressure;

a central cleaning area comprising an air flow chamber;

a blower for producing a flow of air through the central cleaning area;

a filter for filtering the air flowing through the central cleaning area;

heater means for controlling the temperature of the cassette at or above room temperature to prevent condensation thereon;

a computer-controlled robotic arm disposed in the central cleaning area;

a second plurality of jet spray nozzles coupled to the robotic arm that is controlled to move vertically so that it is lowered into the interior of a moving cassette and wherein the second plurality of jet spray nozzles are coupled to the carbon dioxide source and generates a carbon dioxide spray that is projected into the interior of the cassette to clean it; and an electrostatic control system disposed within the enclosure for controlling buildup of electrostatic charge on the cassette caused by the carbon dioxide spray.

7. The apparatus of claim 6 wherein the filter comprises an ultra low particulate air filter.

8. The apparatus of claim 6 wherein the heater means are disposed on opposite sides of the central cleaning area.

* * * * *